US005537905A

United States Patent [19]

Zimmer et al.

[11] Patent Number: 5,537,905

[45] Date of Patent: Jul. 23, 1996

[54] NICKED CUTTING RULE

[75] Inventors: Gregory Zimmer, Franklin Lakes; Richard M. Ulvila, Salisbury Mills, both of N.J.

[73] Assignee: Zimmer Industries, Inc., Hawthorne, N.J.

[21] Appl. No.: 303,227

[22] Filed: Sep. 8, 1994

[51] Int. Cl.[6] ..... B26F 1/14

[52] U.S. Cl. ..... 83/660; 83/695; 83/697

[58] Field of Search ..... 83/651, 652, 660, 83/679, 684, 698.11, 698.71, 695, 697; 76/107.8

[56] References Cited

U.S. PATENT DOCUMENTS

| | | | |
|---|---|---|---|
| 2,361,288 | 10/1944 | Hardy, Jr. | 83/679 |
| 2,401,310 | 6/1946 | Mayhew | 83/695 |
| 2,731,902 | 7/1955 | Biss | 83/652 |
| 3,411,208 | 11/1968 | Malm | 83/652 X |
| 3,824,887 | 7/1974 | Marchard | 83/697 X |
| 4,829,854 | 5/1989 | Kammerling-Essmann | 76/107.8 |
| 5,117,721 | 6/1992 | Montrose | 83/660 |
| 5,240,755 | 8/1993 | Zimmer | 83/660 X |

FOREIGN PATENT DOCUMENTS

| | | | |
|---|---|---|---|
| 1194517 | 10/1985 | Canada . | |
| 1141858 | 12/1962 | Germany | 83/697 |
| 3921216 | 2/1990 | Germany | 83/660 |

*Primary Examiner*—Eugenia Jones
*Attorney, Agent, or Firm*—Brooks Haidt Haffner & Delahunty

[57] ABSTRACT

A perforating rule for perforating paper and plastic including a shank portion having substantially planar side surfaces parallel to a central plane therebetween, a cutting portion having a V-shaped cross-section with the narrower end of the V providing a cutting edge, the cutting portion having portions separated by a plurality of notches extending inwardly from the cutting edge toward the shank portion, and an intermediate portion interconnecting the shank and cutting portions having opposite side surfaces extending from the shank portion to the cutting portion. The thickness of the rule at about 0.024 inch from the cutting edge is about 0.014 inches, the notches have a width in the direction of the length of the rule of about 0.007 inches and a depth of about 0.025 inches, and the portions of the cutting portion have a width in the direction of the length of the rule greater than the width of the notches. The tooth shape and spacing of the perforating rule reduces the stresses placed on the material or stock during cutting, thereby preventing premature rupture of ties along a line of weakness.

12 Claims, 2 Drawing Sheets

NICKED CUTTING RULE

FIELD OF THE INVENTION

The present invention relates to an improved rule used to partially cut material from paper or plastic stock, such as a web, flat stock, etc. of such material, in a manner and by an apparatus which can cause the edges of material removed from the stock to appear to the naked eye to have been cut by a die with a continuous cutting edge.

BACKGROUND OF THE INVENTION

Dies for cutting webs to provide lines of weakness for separating portions of a web from other portions of the web are known in the art. See, for example, U.S. Pat. No. 5,117,721. Such dies include a toothed cutting rule mounted on a flat or rotary die board. Instead of a continuous cutting edge, the rule has a series of teeth separated by notches or nicks. When pressed into the material to be cut, the teeth make a series of cuts through the material and leave a corresponding series of bridges, lands or ties there-between, forming the lines of weakness. Portions of the material formed in this manner, e.g., sheet stock, are separated from the adjacent material by rupturing the ties along one or more of these lines of weakness. However, to be commercially acceptable, the edges of the removed material often should have an appearance which, to the naked eye, is substantially the same as one which has been cut with a die having a continuous cutting edge. See, for example, U.S. Pat. No. 5,240,755 and Canadian Patent No. 1,194,517. The cutting rule described in said U.S. Pat. No. 5,117,721 does not meet this requirement because of the shape, size and spacing of the teeth.

One problem in using conventional cutting rule is that when the teeth are forced into the stock, the rule not only cuts through the stock at the cutting edges of the teeth, but also pushes the tie areas therebetween outward, and when the desired, or to be used, part or product is removed from the stock, there are irregular raised areas or bumps along the edges of the desired part. These bumps, which are visible to the naked eye, must be sanded off to give a product formed from the web a more aesthetic appearance. A further problem is that conventional perforating rules have a cross-sectional shape, as illustrated in FIG. 4, which, when cutting, locally stresses the material along the area proximate to the cutting edge of the rule. The stresses, if not adequately distributed, could rupture the ties of the material within the notches between the teeth, particularly where the ties are closely-spaced to one another. When the ties are sufficiently separated, stresses generated by the rule teeth pushing into the web are distributed along the three dimensions of web material, thereby reducing tie rupture. However, by increasing the spacing between ties, i.e. the width of the cuts, the strength of the connection between the final or desired part and adjacent material is reduced, which can be unsatisfactory for subsequent processing of the stock, unless the width of the tie is increased which can make the ties more readily observable when the final or desired part is separated from adjacent material. Accordingly, there is a need for a rule having an improved tooth shape and spacing which reduce the amount of stress on the web material, eliminates or reduces the rupturing of ties even if closely-spaced, and also prevents the formation of visible imperfections at the edges of the part removed from the stock.

Another problem associated with conventional rule is limited bendability and flexibility, particularly if the rule is heat-treated to increase its hardness and durability. The prior art rule shown in cross-section in FIG. 4, for example, has a thickness of approximately 2 points, or 1/36 inch, a metal thickness which, if hardened by heat-treatment, would cause the rule to fracture if bent. Thus, the conventional rule of FIG. 4 may be suitable only for making rectilinear perforations, and rules for making curved or non-linear cuts would either be made of a softer, bendable and less durable material or would require special manufacture. Accordingly, there is a need for rules that have both the durability of hardened rules and the flexibility of softer ones.

SUMMARY OF THE INVENTION

One object of the invention is to provide an improved rule tooth shape that eliminates protruding areas and other imperfections formed along the lines of weakness which for commercial acceptability require sanding.

A further object of the invention is to provide an improved rule tooth shape and spacing that reduces or better distributes the stresses placed on the material or stock during the cutting process, thereby preventing premature rupture of ties along a line of weakness.

Even though the cutting rule of the invention differs from prior cutting rules, the cutting rule of the invention requires no change in conventional diemaking or diecutting procedures. The rule of the invention cuts with markedly less pressure and retains sharpness longer than prior art rules. Also, the rule provides products with less edge crush and smoother edges without sanding and minimizes "angel hair", dusting and flaking even with tough to cut recycled materials. Presses can run faster with greater product control, and the portion delineated by the cuts is adequately held to adjacent material by the ties for subsequent processing and yet, such portion separates cleanly from adjacent material providing more controllable stripping. When the notches between teeth are evenly spaced, pivoting, snagging and hinging are eliminated, and when the notches have a width of 0.007 inch or less, the ties are invisible to the naked eye even when the desired portion is separated from adjacent material. Product "feel", appearance and quality are improved, and the rule can be bent so as to produce product with irregular, curved and other outlines.

In accordance with the invention, there is provided a rule for cutting paper and plastic stock having: a shank portion having substantially planar side surfaces parallel to a central plane therebetween, a cutting portion having a V-shaped cross-section with the narrower end of the V at the edge of the rule remote from the shank portion to provide a cutting edge, the cutting portion having portions separated by a plurality of notches extending inwardly from the cutting edge toward the shank portion, and an intermediate portion interconnecting the shank and cutting portions having opposite side surfaces extending from the shank portion to the cutting portion, the thickness of the intermediate portion between the respective side surfaces thereof being less than the thickness of the shank portion between the respective parallel side surfaces thereof.

In a first preferred embodiment, the side surfaces of the intermediate portion taper from the parallel side surfaces of the shank portion to the cutting portion.

According to a second embodiment, the side surfaces of the intermediate portion are parallel about the central plane with the thickness of the shank portion being greater than the thickness of the intermediate portion.

BRIEF DESCRIPTION OF THE DRAWINGS

Other objects and advantages of the present invention will be apparent from the following detailed description of the presently preferred embodiments thereof, which description should be conducted in conjunction with the accompanying drawings in which.

DETAILED DESCRIPTION OF THE PREFERRED EMBODIMENT

Figure 1:
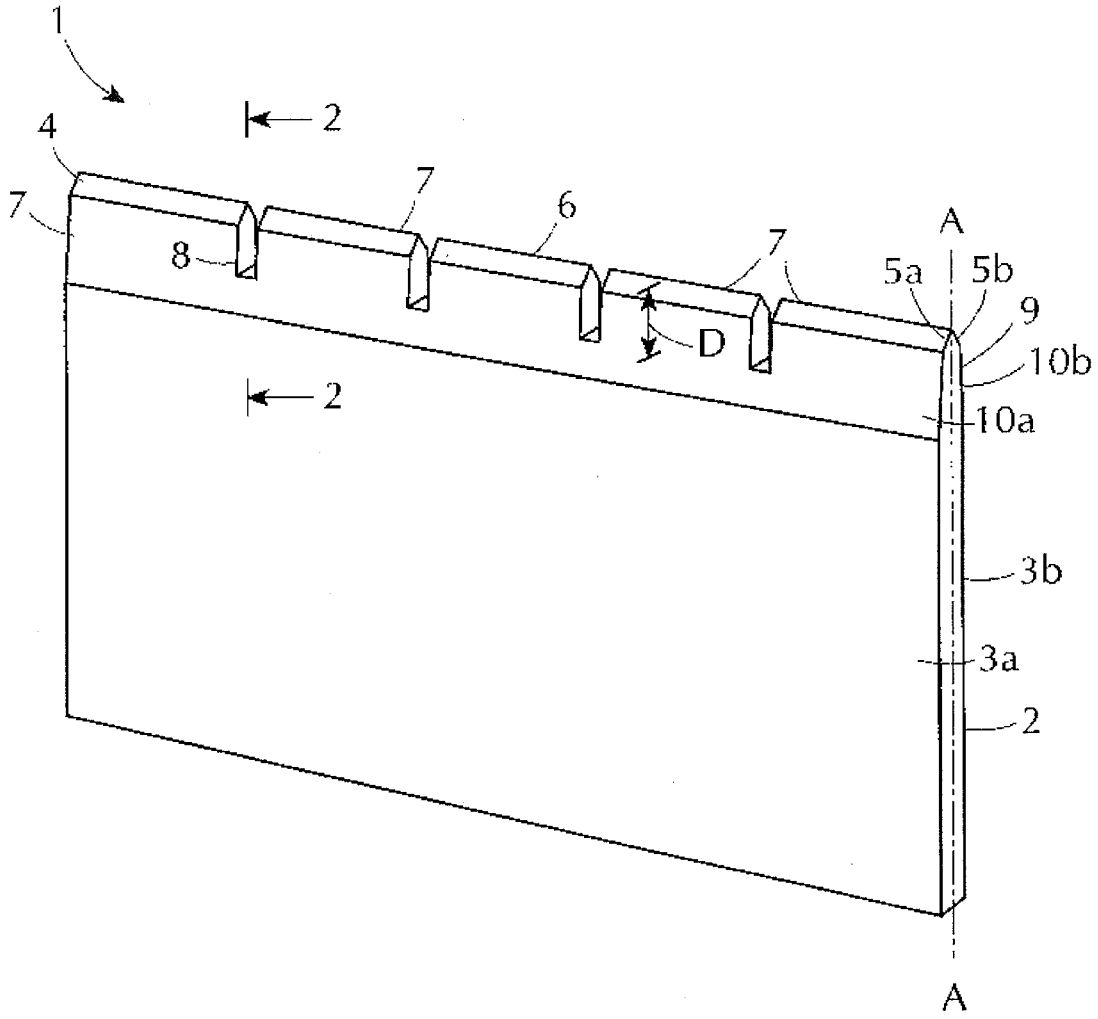
FIG. 1 is a fragmentary, perspective view of a first embodiment of a rule for cutting stock in accordance with the present invention.

Referring now to the drawings, there is shown in FIG. 1 a fragmentary, perspective view of a first and presently preferred embodiment of a rule in accordance with the present invention, which is used to perforate paper or plastic material or stock, and which is designated generally by the numeral 1. The rule 1 is generally an elongated flat strip substantially symmetric about a central plane A—A. The rule 1 comprises a shank portion 2 having opposite and substantially planar side surfaces 3*a* and 3*b* which are substantially parallel to the central plane A—A therebetween.

Figure 2:
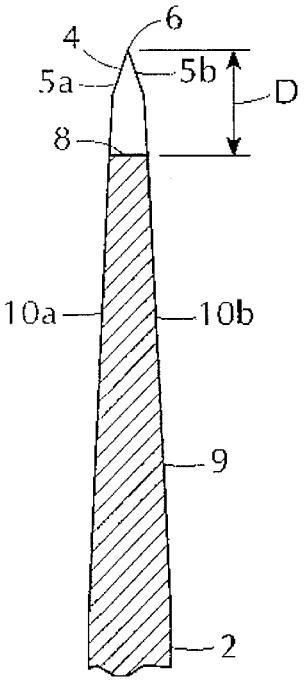
FIG. 2 is an end cross-sectional view along the line 2—2 of the die shown in FIG. 1.

Rule 1 also includes a cutting portion 4 having a V-shaped cross-section, as shown in FIG. 2, with side surfaces 5*a* and 5*b* tapering from the wider end of the V to the narrower end at the edge of the rule 1 remote from the shank portion 2 to provide a cutting edge 6, substantially aligned along the central plane A—A. As shown in FIG. 1, however, instead of a continuous cutting edge, cutting portion 4 has a plurality of teeth 7 separated by a corresponding plurality of notches or nicks 8 extending inwardly from the cutting edge 6 toward shank portion 2 to a depth D, as shown in FIG. 1.

Rule 1 further comprises an intermediate portion 9, interconnecting the shank 2 and cutting portions 4, having opposite side surfaces 10*a* and 10*b* extending from the side surfaces 3*a* and 3*b*, respectively, of the shank portion 2 to the cutting portion 4 at the wider end of the V. In this first and presently preferred embodiment, the side surfaces 10*a* and 10*b* of the intermediate portion 9 each taper from the side surfaces 3*a* and 3*b* of the shank portion 2 at a first angle of about 2 degrees with respect to the central plane A—A, and join the cutting portion 4 along the side surfaces 5*a* and 5*b*, respectively, each of which in turn tapers to the cutting edge 6 at a second angle of about 21 degrees with respect to the central plane A—A.

The tapering profile of the rule 1, as shown in cross-section in FIG. 2, has several advantages over that of the conventional rule. As shown in cross-section in FIG. 4, the conventional rule having straight and non-tapering sides, has a substantially uniform thickness throughout, even up to the cutting portion, of about 2 points. Thus, if all or a part of the rule, e.g., the cutting portion and the immediate area thereabout, were heat-treated to harden the rule material, the thicker conventional rule, although suitable for making rectilinear perforations in the material, would be unsuitable for making non-rectilinear perforations since hardened die material of about 2 points thickness tends to fracture when bent. However, since unhardened rule, although softer and more flexible, has limited durability, heat-treatment is necessary for long-lasting rules. Consequently, conventional rule for making non-rectilinear perforations are specially manufactured and thus, are more costly.

Figure 4:
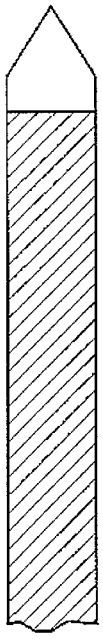
FIG. 4 PRIOR ART
FIG. 4 is an end cross-sectional view of a conventional rule taken along the line 2—2 shown in FIG. 1.

Rule 1 of the present invention, on the other hand, having a thinner hardened area along the cutting portion 4 and all or part of the intermediate portion 9, is more flexible and bendable than the thicker hardened conventional rule shown in FIG. 4 and is less susceptible to stress fracture when bent. To maintain sufficient material strength, however, it is preferred that the thickness of the rule 1 at about 0.024 inch from the cutting edge 6 be close to but no greater than 0.014 inch.

In addition to improved flexibility, the rule 1 of the present invention has an improved configuration for the V-shaped cutting portion 4 which reduces the stresses placed on the material during the cutting process, thereby eliminating or lessening premature tie rupturing as well as the formation of imperfections on finished products visible along the lines of weakness. As shown in FIGS. 1 and 2, the sides 5*a* and 5*b* of cutting portion 4 taper toward the cutting edge 6 at an angle of about 21 degrees with respect to the central plane A—A. Rule 1 therefore has a total cutting angle of about 42 degrees. The conventional rule as shown in FIG. 4, however, has a blunter cutting angle of about 60 degrees. The smaller cutting angle of the present invention is therefore better able to slice through the material than the blunter conventional die, less likely to stress the material, and less likely to rupture the ties or form imperfections along the lines of weakness.

Preferably, the rule 1 of the present invention is made of a steel or steel alloy material and formed in elongated strips of steel stock, e.g., as shown in FIGS. 1 and 2 and can have a length of about 36 inches, height of about 1 inch, and a thickness of about 2 points or 1/36 inch (one point is equal to 1/72 inch). A double bevel is made along one edge of the shank portion 2 length to form tapering sides 10*a* and 10*b* of the intermediate portion 9. The rule 1 is then ground along the edge of the stock to form the cutting portion 4 with the cutting edge 6. The plurality of notches 8 are then cut into the rule 1 transverse to the cutting edge 6 and are preferably equally spaced apart. Rule 1 is heat treated to have a Rockwell C hardness of about 42 as a compromise between wear and bendability. However, if bendability is not a requirement, the teeth 7 can be heat treated to have a higher hardness, e.g. 52–55 Rockwell C, than the remainder of the rule which can, for example, have a Rockwell C hardness of about 35–42.

In order to cut heavy paper and thin sheets of plastic, the depth D of the notches 8, i.e., the height of the teeth 7, is preferably about 0.025 inch. Also, the height of cutting portion 4 in this preferred embodiment is about 0.01 inch and the combined height of the tapered portions, i.e., the intermediate 9 and cutting 4 portions, is about 0.2 inch.

Figure 3:
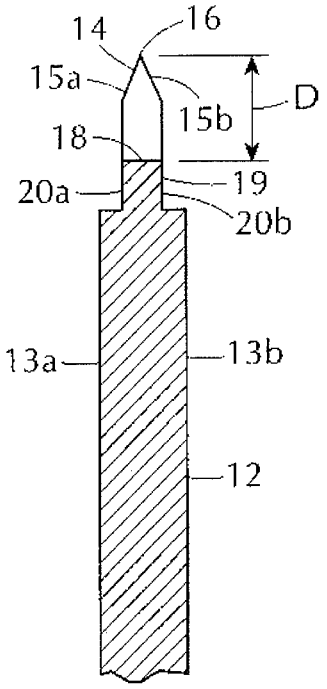
FIG. 3 is an end cross-sectional view of a second embodiment of a rule taken along the line 2—2 shown in FIG. 1.

Shown in FIG. 3 is a cross-sectional view, taken along the same line 2—2 as in FIG. 1, of a second embodiment of a rule used to cut web material, which rule is designated generally by the numeral 11. As with the first embodiment, rule 11 includes: a shank portion 12 having opposite and substantially planar side surfaces 13*a* and 13*b* substantially parallel to the central plane A—A therebetween, a cutting portion 14 having a V-shaped cross-section, side surfaces 15*a* and 15*b* tapering from the wider end of the V to the narrower end at the edge of the rule 11 remote from the shank portion 12 to provide a cutting edge 16 which, as in the embodiment shown in FIG. 1, is interrupted by a plurality of teeth 17 separated by notches 18 extending inwardly from the cutting edge 16 toward shank portion 12; and an intermediate portion 19 interconnecting the shank 12 and the cutting portions 14.

This alternate embodiment differs from the rule 1 of the first embodiment in that the opposite side surfaces 20*a* and 20*b* of the intermediate portion 19 extending from the shank portion 12 do not taper with respect to the central plane A—A but are instead, substantially parallel to the central plane A—A. Thus, whereas the thickness of the intermediate portion 9 in the first embodiment tapers from the shank thickness of about 2 points to under 1 point at the cutting portion 4, the thickness of the intermediate portion 19 in the second embodiment is uniform and about 1 point. As discussed in connection with the previous embodiment, the hardness of the entire rule 11 can have a Rockwell C hardness of about 42. However, the cutting portion 14 and all or part of the intermediate portion 19 can be made of a harder material, e.g., a Rockwell C hardness of about 50–55 and the shank portion 12 can have a Rockwell C hardness of about 35–42. Thus, the rule 11 may either be made of a single material only a portion of which, i.e., the cutting 14 and intermediate 19 portions, being selectively hardened by heat-treating or the rule 11 may be formed by separately making the shank portion 12 and the intermediate and cutting portions 14 and 19 as a unit, and after hardening the portions 14 and 19 can be welded to the shank portion 12. When the rule 11 is so formed, the shank potion 12 can have a Rockwell C hardness of about 35–42.

It should be understood that, as in the first embodiment, rule material of about 1 point thickness which is hardened to a Rockwell C hardness of about 55 has substantially the same degree of flexibility and bendability as that of a 2 point thick and unhardened die material having a Rockwell C hardness of about 42. Thus, the die 11 of the present invention, as with die 1, has the durability of hardened dies, the flexibility of soft dies, and is less likely to fracture when bent. Further, as with the first embodiment, the cutting angle of the V-shaped cutting portion 14 is about 42 degrees and is therefore better able to slice into the web material and prevent localized and harmful stresses on the web material.

The plurality of teeth 17 separated by notches 18 in the second embodiment also have a preferable depth D, as shown in FIG. 3, of about 0.025 inch. Also, cutting portion 14 preferably has a height of about 0.01 inch and the combined height of the cutting 14 and intermediate 19 portions is about 0.035 inch. In general, the depth of the cutting portion 4 and 14 in both embodiments is less than one-third of the depth of the intermediate portion 9 and 19 respectively.

Figure 5:
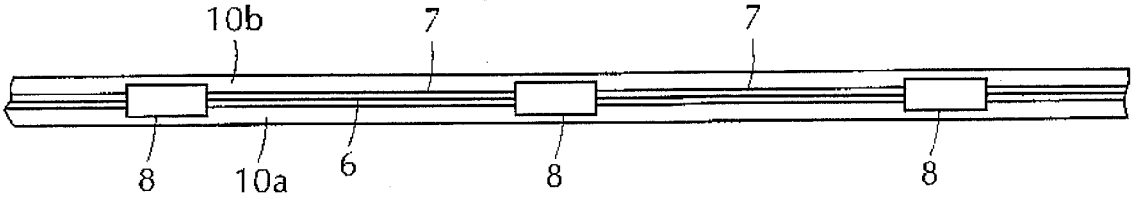
FIG. 5 is a top end view along the cutting edge of a portion of the rule shown in FIGS. 1 and 2.
Figure 6:
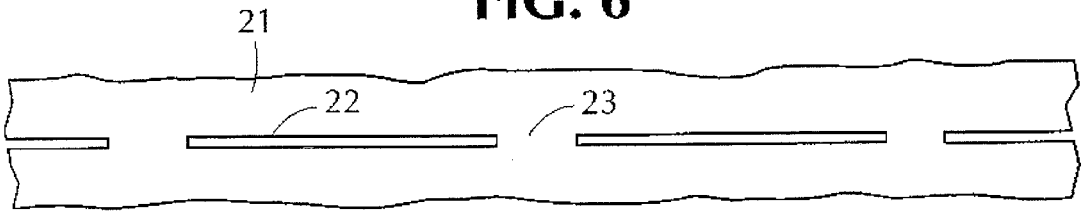
FIG. 6 is a top view of a surface portion of a web cut by the rule shown in FIG. 5.

Shown in FIGS. 5 and 6 are, respectively, the rule 1 constructed in accordance with the first embodiment of the present invention having a plurality of teeth 7 separated by notches 8, and a portion of a web material 21 having a plurality of cuts or perforations 22 formed by the die 1. Between pairs of the perforations 22, there are ties 23 of the web material 21, which, if it is desired that the edges of the removed web material have a commercially acceptable appearance, are no longer than about 0.010 inch along the line of weakness, and are preferably are about 0.007 inch. In any event, it should be understood that the lines of weakness conjoining web portions should not be so weak as to allow inadvertent and premature rupture of the ties 23 during manufacture or prior to use, thereby interrupting the normal flow of the material, e.g., during feeding through a printer. In addition, the lines of weakness should not be so strong as to impede rupturing along that line, thereby damaging the removed material. It should further be understood that the widths of the teeth 7, 17 and the notches 8, 18 in both embodiments may be varied to achieve a desired burst strength or for other purposes. However, in the preferred embodiments of the rules of the invention, there are about four teeth 7 or 17 per inch of rule and the notches or nicks 8 or 18 have a width not greater than about 0.007 inch.

It should be understood that although the notches 8, 18 of the rule in the preferred first and second embodiments of the present invention preferably have a width less than about 0.007 inch in order to create ties 23 of that width, causing the material removed from the web to appear to the naked eye to have been cut by a rule with a continuous cutting edge, but the width of the notches 8, 18 and the ties 23 formed therefrom may be greater than 0.010 inch if a poorer appearance is acceptable.

Although preferred embodiments of the present invention have been described and illustrated, it will be apparent to those skilled in the art that various modifications may be made without departing from the principles of the invention.

The embodiments of the invention in which an exclusive property or privilege is claimed are as follows:

What is claimed is:

1. A perforating rule for perforating paper and plastic comprising:

an elongated metal strip having an edge, a length parallel to said edge, a depth extending from said edge and transversely to said length of said strip and a thickness extending transversely to said depth of said strip and having a cutting portion at said edge, a shank portion spaced from said edge and an intermediate portion interconnecting said shank portion and said cutting portion, said cutting portion being V-shaped in cross-section with about a 42° included angle with the narrower end of the V at said edge of said strip to provide a cutting edge, said cutting portion having portions separated in the direction of said length by a plurality of notches extending inwardly from said cutting edge toward said shank portion, said shank portion having substantially planar side surfaces substantially parallel to a central plane therebetween, said cutting portion having side surfaces at opposite sides of said plane and said intermediate portion having side surfaces at opposite sides of said plane and extending from said shank portion to and joining said side surfaces of said cutting portion, the thickness of said intermediate portion between said side surfaces of said intermediate portion and the thickness of said cutting portion being less than the thickness of the shank portion between said side surfaces of said shank portion, the thickness of said rule at about 0.024 inch from the cutting edge being, said notches having a width in the direction of said length of said strip of about 0.007 inches and a depth of about 0.025 inches and said portions of said cutting portion being at least four per inch of length of said strip and having a width in the direction of said length greater than said width of said notches.

2. The rule as set forth in claim 1, wherein said side surfaces of said intermediate portion extend from said planar side surfaces of said shank portion to said cutting portion at an angle of about 2 degrees with respect to said central plane.

3. The rule as set forth in claim 2, wherein the side surfaces of said V-shaped cutting portion taper from said opposite side surfaces of said intermediate portion at a second angle with respect to said central plane greater than said angle of said side surfaces of said intermediate portion with respect to said central plane.

4. The rule as set forth in claim 1, wherein said side surfaces of said intermediate portion are substantially parallel, and at an angle less than 2 degrees, to said central plane.

5. The rule as set forth in claim 1, wherein said shank portion has a thickness between said side surfaces of about 2 points.

6. The rule as set forth in claim 1, wherein said cutting portion has a depth in the direction from said cutting edge toward said shank portion less than one-third of the depth of said intermediate portion in said direction.

7. The rule as set forth in claim 1, wherein said cutting portion has a depth of about 0.01 inch and the combined height of said intermediate portion and said cutting portion is about 0.2 inch.

8. The rule as set forth in claim 7, wherein said rule is made of a steel or a steel alloy material.

9. The rule as set forth in claim 8, wherein said cutting portion of said rule has a hardness greater than the hardness of said shank portion.

10. The rule as set forth in claim 9, wherein said cutting portion has a Rockwell C hardness from about 52 to about 55 and said shank portion has a Rockwell C hardness of about 35 to about 42.

11. The rule as set forth in claim 10, wherein said cutting portion and said intermediate portion are unitary and said intermediate portion is welded to said shank portion.

12. The rule as set forth in claim 9, wherein said intermediate and cutting portions have a Rockwell C hardness of about 52 to about 55 and said shank portion has a Rockwell C hardness less than 52.

* * * * *

UNITED STATES PATENT AND TRADEMARK OFFICE

CERTIFICATE OF CORRECTION

PATENT NO. : 5,537,905

DATED : July 23, 1996

INVENTOR(S) : Zimmer et al

It is certified that error appears in the above-indentified patent and that said Letters Patent is hereby corrected as shown below:

Col. 6, line 57, after "being" insert --about 0.014 inches--.

Signed and Sealed this

Twenty-fourth Day of December, 1996

*Attest:*

BRUCE LEHMAN

*Attesting Officer*

*Commissioner of Patents and Trademarks*